US011604427B2

(12) United States Patent
Kohama

(10) Patent No.: US 11,604,427 B2
(45) Date of Patent: Mar. 14, 2023

(54) IMAGE FORMING APPARATUS HAVING A HEATER FOR HEATING A TONER IMAGE

(71) Applicant: KYOCERA Document Solutions Inc., Osaka (JP)

(72) Inventor: Atsushi Kohama, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/580,411

(22) Filed: Jan. 20, 2022

(65) Prior Publication Data

US 2022/0236672 A1 Jul. 28, 2022

(30) Foreign Application Priority Data

Jan. 27, 2021 (JP) ..... JP2021-010904

(51) Int. Cl.

*G03G 15/20* (2006.01)
*G03G 15/00* (2006.01)
*G03G 21/16* (2006.01)

(52) U.S. Cl.

CPC ..... *G03G 15/205* (2013.01); *G03G 15/55* (2013.01); *G03G 15/80* (2013.01); *G03G 21/1633* (2013.01)

(58) Field of Classification Search

CPC ..... G03G 15/2017; G03G 15/2039; G03G 15/2042; G03G 15/205; G03G 15/5004; G03G 15/55; G03G 15/80; G03G 21/1633

See application file for complete search history.

(56) References Cited

U.S. PATENT DOCUMENTS

2007/0242960 A1* 10/2007 Kobayashi ..... G03G 15/5004 399/13

FOREIGN PATENT DOCUMENTS

JP 2012-042573 A 3/2012

* cited by examiner

*Primary Examiner* — Sophia S Chen
(74) *Attorney, Agent, or Firm* — Stein IP, LLC

(57) ABSTRACT

An image forming apparatus includes a plurality of heaters, a switch portion, and first and second supply lines. The heaters heat a toner image. The switch portion is connected to an alternating-current power source, and opens and closes in a manner interlocked with the opening and closing of a cover. The first supply line connects the respective one ends of the heaters to the switch portion. The second supply line connects the respective other ends of the heaters to the switch portion. The second supply line has a branch portion. The respective other ends of the heaters are each connected to one of branch lines which are electric wires that branch off from the branch portion. The switch portion is disposed between the branch portion and the alternating-current power source.

8 Claims, 12 Drawing Sheets

IMAGE FORMING APPARATUS HAVING A HEATER FOR HEATING A TONER IMAGE

INCORPORATION BY REFERENCE

This application is based on and claims the benefit of priority from Japanese Patent Application No. 2021-010904 filed on Jan. 27, 2021, the contents of which are hereby incorporated by reference.

BACKGROUND

The present disclosure relates to an image forming apparatus that includes a heater for fixing a toner image.

An image forming apparatus that prints with toner is provided with a fixing device. In general, a fixing device includes a heater for heating a toner image transferred to a sheet, and is often provided with a mechanism that cuts off the supply of electric power to the heater on detecting an excessive rise in the temperature of a component that is heated by the heater.

Some image forming apparatuses permit a part of their cover (cabinet) to be opened. The cover is opened to allow maintenance work. A maintenance serviceperson opens the cover and checks and tests the interior. A serviceperson can, for example, replace a component, remove a jammed sheet, and perform cleaning.

SUMMARY

According to one aspect of the present disclosure, an image forming apparatus includes a plurality of heaters, a switch portion, a first supply line, and a second supply line. The plurality of heaters heats a toner image. The switch portion is connected to an alternating-current power source. The switch portion opens and closes in a manner interlocked with the opening and closing of a cover. The first supply line connects the respective one ends of the heaters to the switch portion. The second supply line connects the respective other ends of the heaters to the switch portion. The second supply line has a branch portion. The respective other ends of the heaters are each connected to one of branch lines which are electric wires that branch off from the branch portion. The switch portion is disposed between the branch portion and the alternating-current power source.

This and other objects of the present disclosure, and the specific benefits obtained according to the present disclosure, will become apparent from the description of embodiments which follows.

DETAILED DESCRIPTION

An embodiment of the present disclosure, and a modified example of it, will be described below with reference to FIGS. 1 to 11. First, with reference to FIGS. 1 to 9, an image forming apparatus according to the embodiment will be described. After that, with reference to FIGS. 10 and 11, an image forming apparatus according to the modified example will be described. The following description discusses a printer as an example of both the image forming apparatus according to the embodiment and that according to the modified example. Any features specifically described herein in terms of structure, arrangement, and the like in connection with the embodiment are merely examples for the sake of description and are not meant to limit the scope of the present disclosure.

Figure 1:
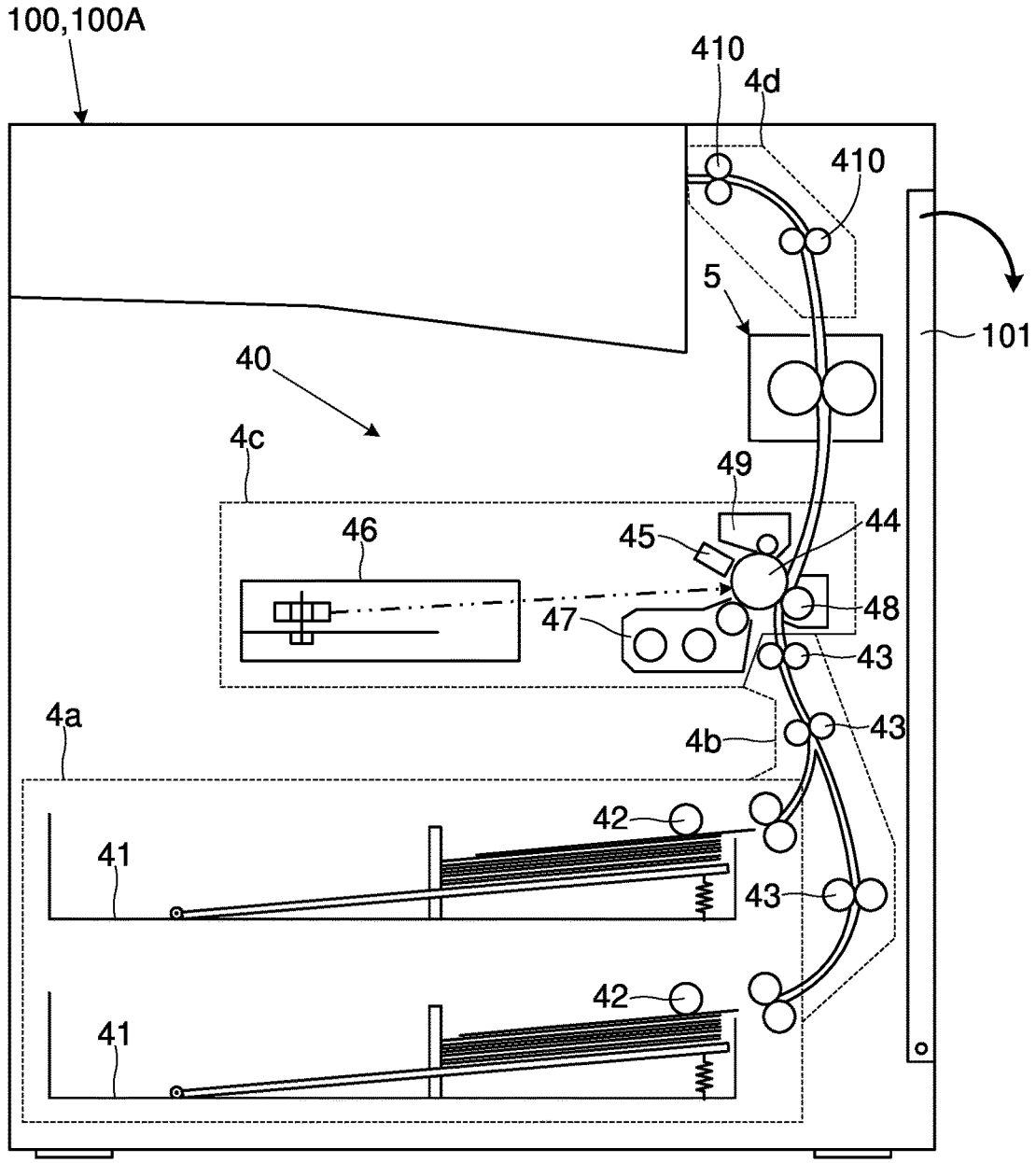
FIG. 1 is a diagram showing one example of a printer according to an embodiment.
Figure 2:
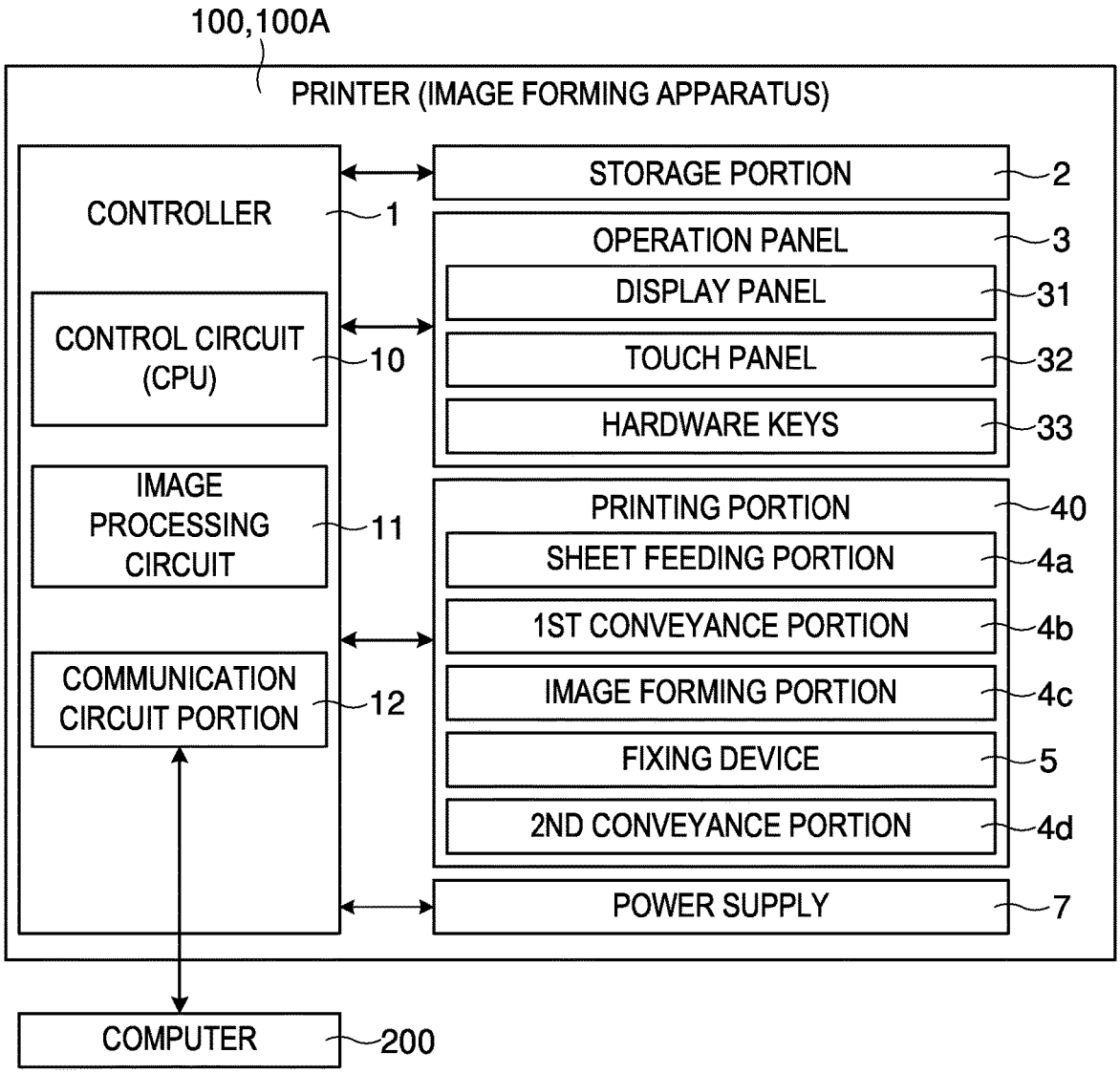
FIG. 2 is a diagram showing one example of the printer according to the embodiment.

Printer 100: FIGS. 1 and 2 are diagrams showing one example of the printer 100 according to the embodiment. As shown in FIGS. 1 and 2, the printer 100 includes a printing portion 40. The printing portion 40 includes a sheet feeding portion 4*a*, a first conveyance portion 4*b*, an image forming portion 4*c*, a fixing device 5, and a second conveyance portion 4*d*. The sheet feeding portion 4*a* is disposed in a lower part inside the printer 100. The sheet feeding portion 4*a* includes a plurality of sheet feed cassettes 41 and a plurality of sheet feed rollers 42. Each sheet feed cassette 41 stores a plurality of sheets. In a print job, one of the sheet feed rollers 42 rotates, and as a result sheets are fed out of the corresponding one of the sheet feed cassettes 41.

The first conveyance portion 4*b* conveys a sheet fed out from the sheet feeding portion 4*a* to the image forming portion 4*c*. The first conveyance portion 4*b* includes a plurality of pairs of first conveyance rollers 43. In a print job, those pairs of first conveyance rollers 43 rotate, and as a result the sheet is conveyed. The sheet is conveyed along a conveyance guide in the first conveyance portion 4*b*.

The image forming portion 4*c* includes a photosensitive drum 44, a charging device 45, an exposure device 46, a developing device 47, a transfer roller 48, and a cleaning device 49. The photosensitive drum 44 is rotatably supported. During printing, the photosensitive drum 44 rotates at a predetermined speed. The charging device 45 electrostatically charges the surface of the photosensitive drum 44 to a predetermined potential. The exposure device 46 irradiates the electrostatically charged photosensitive drum 44 with an optical signal (laser light, indicated by a dash-dot-dot line) based on the image data of the image to be printed. As a result, an electrostatic latent image is formed on the circumferential surface of the photosensitive drum 44. The developing device 47 lets toner fly to develop the electrostatic latent image on the photosensitive drum 44. The transfer roller 48 is disposed in contact with the photosensitive drum 44. The sheet passes through the nip (transfer nip) between the transfer roller 48 and the photosensitive drum 44. In a print job, the transfer roller 48 has a predetermined transfer voltage applied to it. Thus the toner image is transferred to the sheet. The cleaning device 49 cleans the photosensitive drum 44 after transfer.

The fixing device 5 heats and presses the sheet having the toner image transferred to it. Thus the toner image is fixed to the sheet. The fixing device 5 then feeds the sheet out to the second conveyance portion 4*d*. The second conveyance portion 4*d* includes a plurality of pairs of second conveyance rollers 410. In a print job, those pairs of second conveyance rollers 410 rotate. As a result, the second conveyance portion 4*d* conveys the sheet having passed through the fixing device 5 further toward a discharge tray.

As shown in FIG. 2, the printer 100 includes a controller 1, a storage portion 2, and an operation panel 3. The controller 1 controls the operation of the printer 100. The controller 1 is, for example, a circuit board. The controller 1 includes a control circuit 10, an image processing circuit 11, and a communication circuit portion 12. The control circuit 10 is, for example, a CPU. Based on programs and data stored in the storage portion 2, the control circuit 10 performs calculation and processing. The control circuit 10 controls the operation of different blocks in the printer 100. For example, in a print job, the controller 1 controls the operation of the sheet feeding portion 4*a*, the first conveyance portion 4*b*, the image forming portion 4*c*, the fixing device 5, and the second conveyance portion 4*d*.

The image processing circuit 11 is, for example, an ASIC. An ASIC is an integrated circuit designed for image processing. The communication circuit portion 12 receives print data. Based on data (data defined in a page description language) contained in the received print data, the image processing circuit 11 generates image data (raster data). In accordance with print settings (setting data) on a computer 200, the image processing circuit 11 performs image processing on the raster data to generate print output image data. Based on the print output image data, the controller 1 has the photosensitive drum 44 exposed to light from the exposure device 46.

The communication circuit portion 12 includes a connector, a communication processing circuit (communication IC), and a communication memory. The communication circuit portion 12 communicates with the computer 200. The communication memory stores communication software. Based on the communication software, the communication processing circuit performs communication processing. The computer 200 is, for example, a PC or a server. The communication circuit portion 12 receives print data transmitted from the computer 200.

The printer 100 includes, as the storage portion 2, a ROM and a RAM. The printer 100 may include, as the storage portion 2, a storage. The storage is, for example, a HDD or a SSD or both.

The printer 100 includes an operation panel 3. The operation panel 3 includes, for example, a display panel 31, a touch panel 32, and hardware keys 33. The controller 1 makes the display panel 31 display messages, setting screens, and software keys. Moreover, based on the output of the touch panel 32, the controller 1 recognizes the operated software keys. Based on the output of the hardware keys 33, the controller 1 recognizes the operated hardware keys 33. The operation panel 3 accepts settings.

Figure 3:
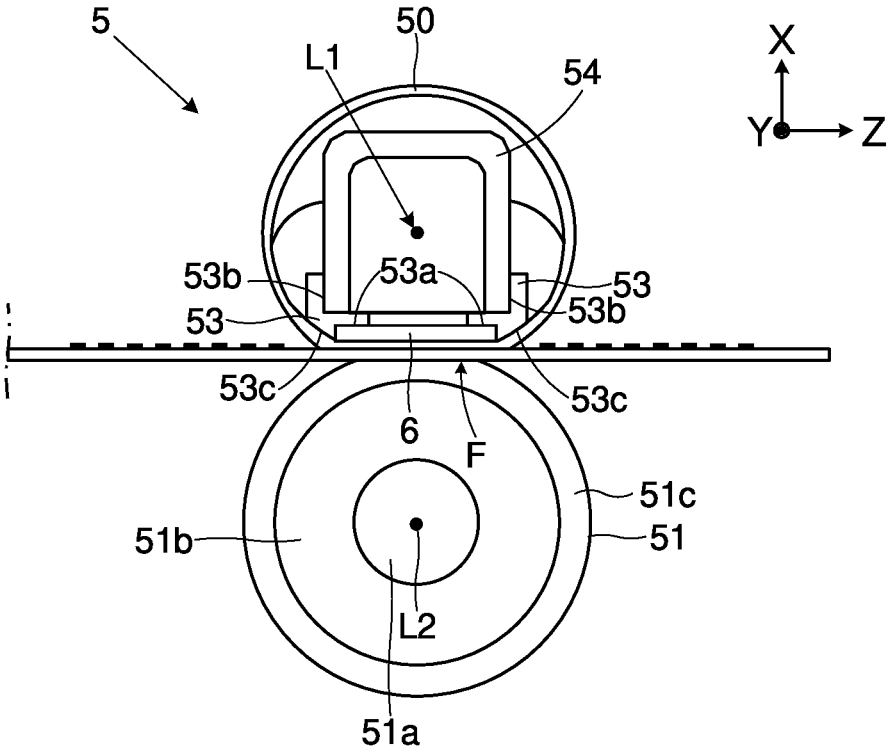
FIG. 3 is a diagram showing one example of a fixing device according to the embodiment.
Figure 4:
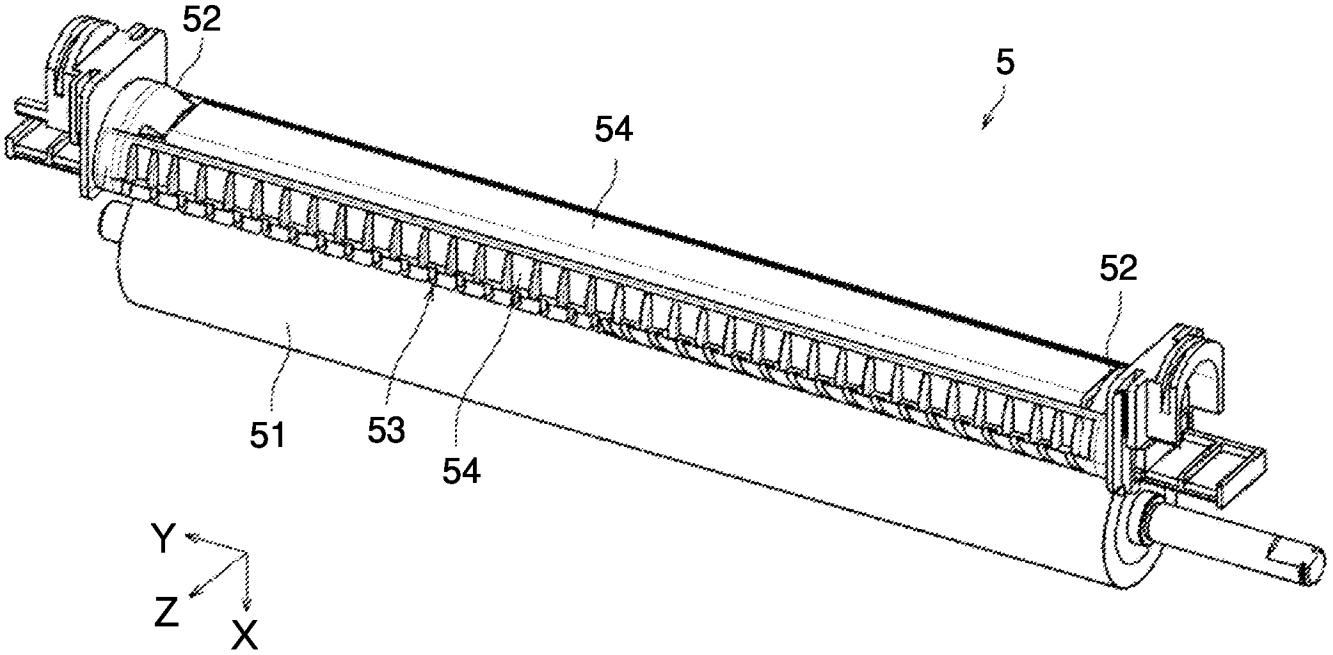
FIG. 4 is a diagram showing one example of the fixing device according to the embodiment.

Fixing Device 5: With reference to FIGS. 3 and 4, one example of the fixing device 5 according to the embodiment will be described. FIGS. 3 and 4 are diagrams showing the example of the fixing device 5 according to the embodiment. FIG. 3 is a diagram showing the example of the fixing device 5 as seen from a direction perpendicular to the sheet conveyance direction. FIG. 4 is a diagram showing one example of the exterior appearance of the fixing device 5 with a fixing belt 50 removed.

As shown in FIGS. 3 and 4, the fixing device 5 includes a fixing belt 50, a pressing roller 51, a heater 6, and a belt edge holding member 52. In the following description, the direction along the axis of rotation of the fixing belt 50 and the pressing roller 51 (i.e., the main scanning direction) is referred to as Y direction; the direction perpendicular to Y direction and parallel to the sheet conveyance direction is referred to as Z direction; and the direction perpendicular to both Z and Y directions is referred to as X direction. X direction is the thickness direction of the sheet.

The heater 6 heats the fixing belt 50. The heated fixing belt 50 heats the sheet having the toner image transferred to it. The fixing belt 50 is endless. The fixing belt 50 is tubular and flexible. The fixing belt 50 rotates, for example, about a first rotation axis L1. The fixing belt 50 extends in Y direction. The belt edge holding member 52 is provided one at each edge of the fixing belt 50 (see FIG. 4). Held between two belt edge holding members 52, the fixing belt 50 is prevented from meandering while moving around. The pressing roller 51 extends along Y direction. The pressing roller 51 includes a rotary shaft 51*a* in a cylindrical shape, an elastic layer 51*b*, and a release layer 51*c*. The rotary shaft 51*a* rotates about a second rotation axis L2 parallel to Y direction.

The fixing device 5 includes the heater 6, a heater holding member 53, and a reinforcement member 54. The heater 6 extends in Y direction. The heater 6 is in the shape of a thin, elongate plate. The heater 6 is, for example, a planar heater. The heater 6 has a plurality of layers. The heater 6 has, for example, at least a glass layer, a heating layer, and a substrate layer. The heating layer is disposed between the glass layer and the substrate layer. The heating layer is, for example, a layer of a heat-generating paint. A heat-generating paint generates heat when energized. The substrate layer is formed of, for example, a ceramic material. For example, the surface of the glass layer makes contact with the fixing belt 50.

The heater holding member 53 holds the heater 6. The heater holding member 53 is formed of, for example, a heat-resistant resin. The heater holding member 53 extends in Y direction. The heater holding member 53 has a bottom wall face 53*a* and a pair of side wall faces 53*b*. The bottom wall face 53*a* faces the heater 6, and makes contact with the face of the heater 6 opposite from its face in contact with the fixing belt 50. To allow measurement of the temperature of the heater 6, the fixing device 5 is provided with a plurality of temperature sensors; for example, it is provided with a first temperature sensor 63*a* and a second temperature sensor 63*b* (see FIG. 6). The heater holding member 53 has a plurality of openings in which those temperature sensors are fitted. Each temperature sensor is fitted in one of those openings so as to make contact with the heater 6.

The reinforcement member 54 keeps the heater holding member 53 in a given position and attitude. The reinforcement member 54 has, as seen from Y direction, the shape of an inverted "U". The reinforcement member 54 extends in Y direction. The reinforcement member 54 lies in contact with the heater holding member 53, and keeps the heater holding member 53 at a fixed position. Inside the tube formed by the fixing belt 50 are disposed the heater 6, the heater holding member 53, the temperature sensors, and the reinforcement member 54. Some of the faces of the heater 6 and of the heater holding member 53 make contact with the inner surface of the fixing belt 50. The face of the heater holding member 53 that makes contact with the inner surface of the fixing belt 50 is referred to as the contact face 53*c*. The heater 6 and the contact face 53*c* give tension to the fixing belt 50. The fixing belt 50 is stretched in a (not exactly circular) cylindrical shape. The region over which the fixing belt 50 makes contact with the pressing roller 51 is the fixing nip region F. In FIG. 3, the rectangular area truncated at one side that is shown between the fixing belt 50 and the pressing roller 51 depicts a sheet; the solid black rectangular areas shown on the top side of the rectangular area depicting the sheet depict toner. Shown in FIG. 3 is one example of the state where a sheet is nipped between the fixing belt 50 and the pressing roller 51.

The heater 6 receives a pressure from the pressing roller 51 via the fixing belt 50. The heater 6 receives a pressure also from the reinforcement member 54 via the heater holding member 53. The heater 6 is kept at a fixed position. To enable the pressing roller 51 to rotate, a fixing motor (not shown) is provided. The pressing roller 51 rotates by being driven by the fixing motor. As the pressing roller 51 rotates, following it the fixing belt 50 moves around.

Figure 5:
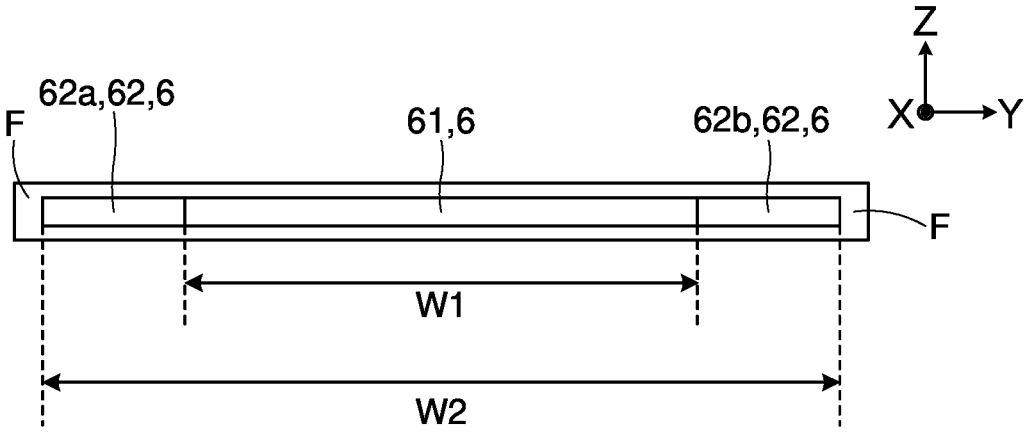
FIG. 5 is a diagram showing one example of the arrangement of heaters in the fixing device according to the embodiment.

Heater 6: Next, with reference to FIG. 5, one example of the heater 6 provided in the fixing device 5 according to the embodiment will be described. FIG. 5 is a diagram showing the example of the arrangement of the heater 6 provided in the fixing device 5 according to the embodiment.

The fixing device 5 includes the heater 6. The heater 6 heats the fixing nip region F over its entire length in Y direction (the longitudinal direction of the fixing belt 50; the direction perpendicular to the sheet conveyance direction; the main scanning direction). In the printer 100, the heater 6 is divided into a plurality of parts. The following description discusses an example where the fixing device 5 includes two heaters: a first heater 61 and a second heater 62. The fixing device 5 may include three or more heaters 6.

The first and second heaters 61 and 62 are disposed on a straight line (arranged side by side) along Y direction. The first heater 61 heats middle parts of the fixing belt 50 and the fixing nip region F in Y direction. The second heater 62 heats opposite end parts of the fixing belt 50 and the fixing nip region F in Y direction.

FIG. 5 is a diagram showing one example of the arrangement of the first and second heaters 61 and 62 in the fixing device 5. The largest rectangular area in FIG. 5 represents the fixing nip region F. The first heater 61 is disposed at a position where it heats a middle part of the fixing nip region F in Y direction. The second heater 62 heats end parts of the fixing nip region F in Y direction. The heating width W1 of the first heater 61 in Y direction is, for example, equal to the dimension of the shorter sides of the A4 sheet, or larger, by a predetermined margin width, than that dimension. The margin width is, for example, several millimeters to several centimeters. When printing is performed on a sheet of which the width in Y direction (main scanning direction) is equal to or smaller than the dimension of the shorter sides of the A4 sheet, the controller 1 operates only the first heater 61. In this way, it is possible to prevent an excessive rise in temperature at the opposite edges of the fixing belt 50. The heating width W2 in Y direction during heating with both the first and second heaters 61 and 62 is larger than the heating width W1. The heating width W2 is larger than the dimension of the shorter sides of the A3 sheet.

When printing is performed on a sheet of which the width in Y direction (main scanning direction) is greater than the dimension of the shorter sides of the A4 sheet, the controller 1 operates the first and second heaters 61 and 62. As shown in FIG. 5, the second heater 62 is divided into two parts disposed at separate positions. Specifically, the second heater 62 is divided into a first division heater 62*a* and a second division heater 62*b*. The first and second division heaters 62*a* and 62*b* are electrically connected in series with each other.

Figure 6:
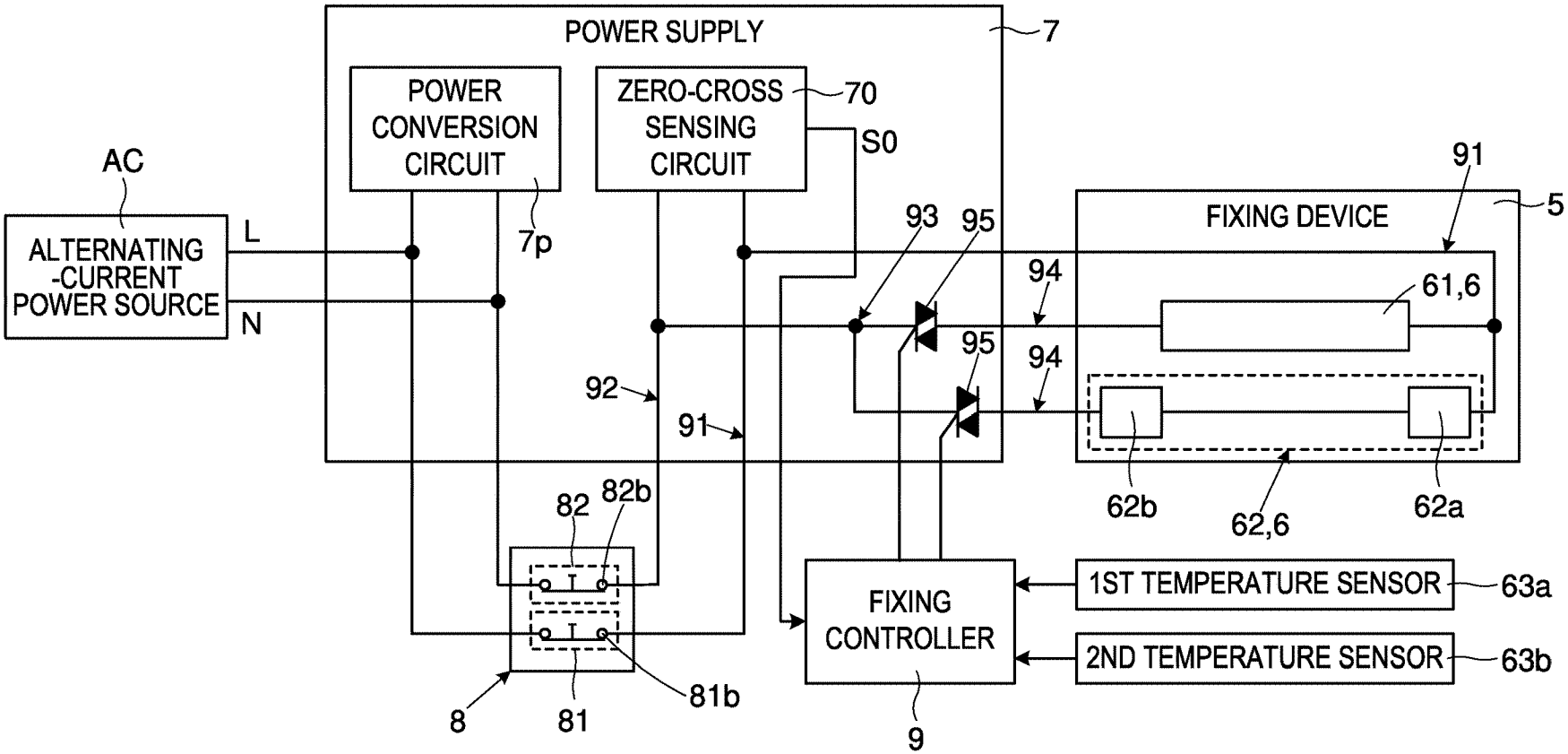
FIG. 6 is a diagram showing one example of the supply of electric power to the heaters in the fixing device according to the embodiment.
Figure 7A:
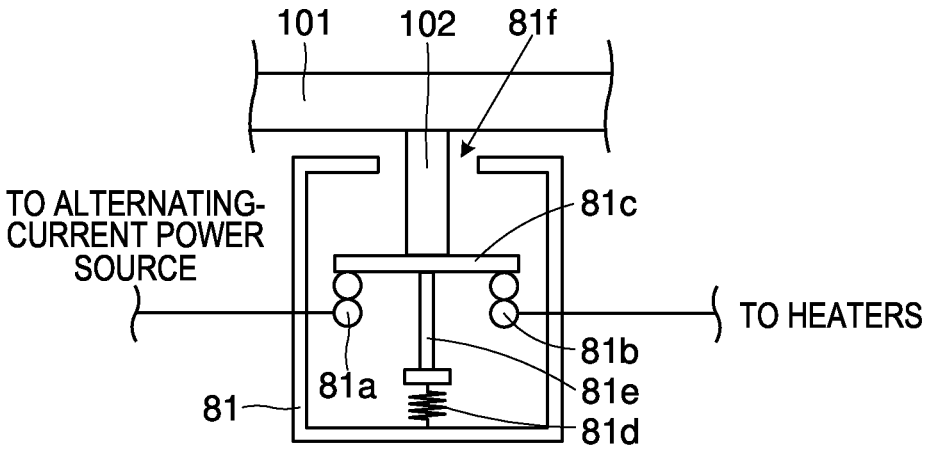
FIGS. 7A and 7B are diagrams showing one example of a first switch according to the embodiment.
Figure 7B:
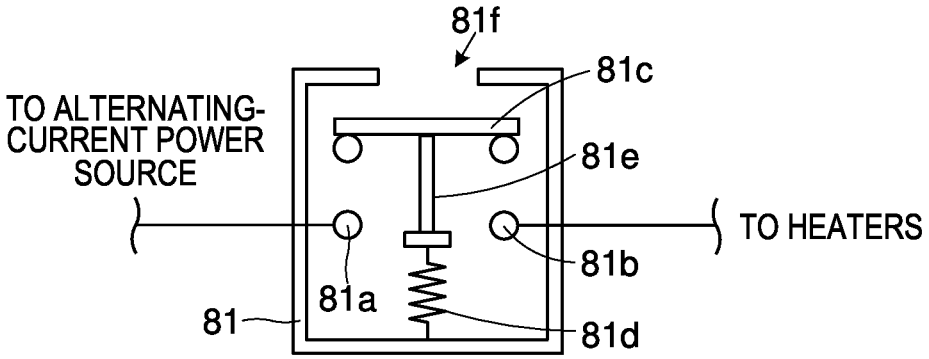
Figure 7C:
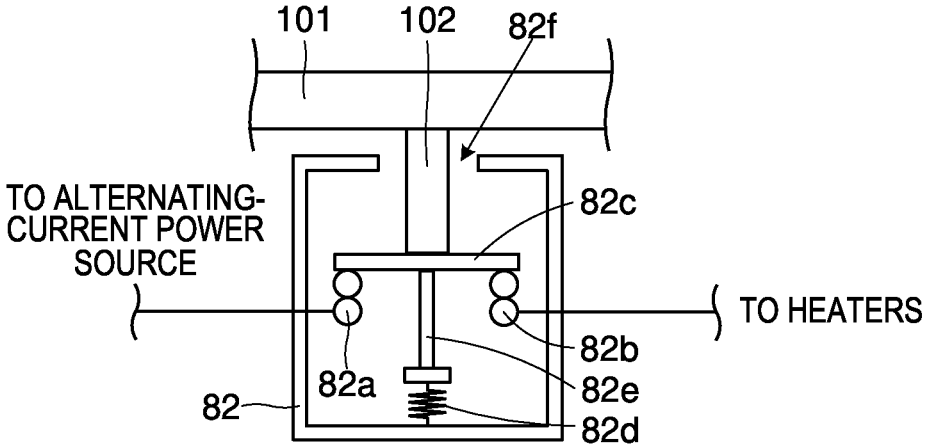
FIGS. 7C and 7D are diagrams showing one example of a second switch according to the embodiment.
Figure 7D:
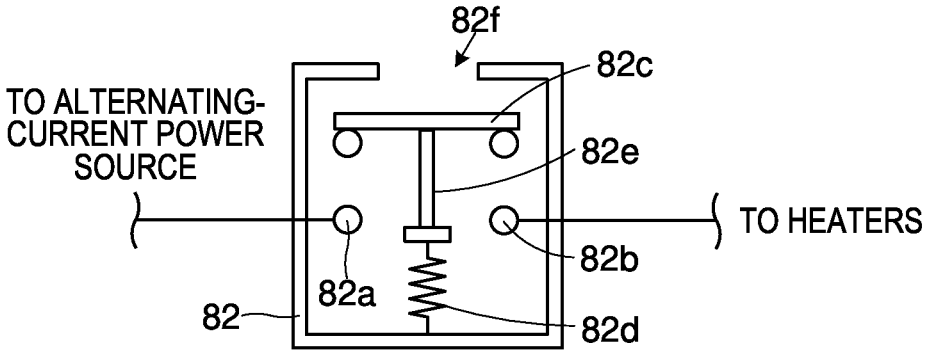
Figure 8:
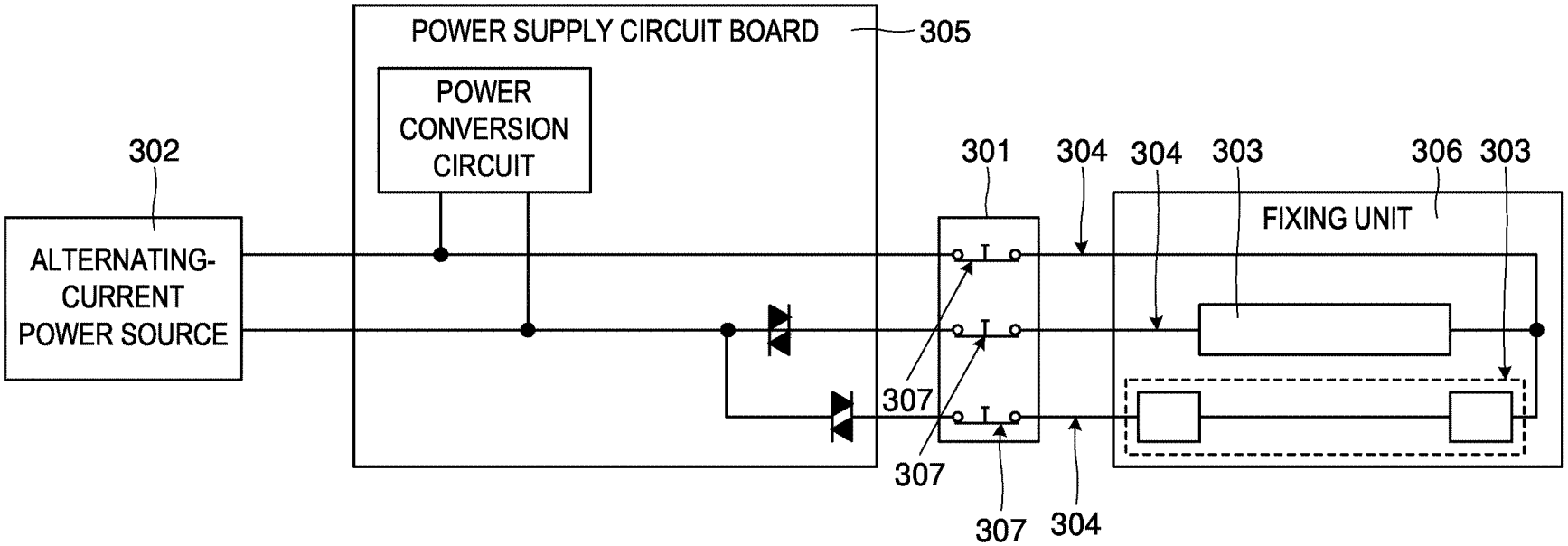
FIG. 8 is a diagram showing one example of the arrangement of a conventional interlock switch unit.

Supply of Electric Power to the Heater 6: Next, with reference to FIGS. 6 to 8, a description will be given of one example of the supply of electric power to and the control of the heater 6 according to the embodiment. FIG. 6 is a diagram showing the example of the supply of electric power to the heater 6 in the fixing device 5 according to the embodiment. FIGS. 7A and 7B are diagrams showing one example of a first switch 81 according to the embodiment, and FIGS. 7C and 7D are diagrams showing one example of a second switch 82 according to the embodiment. FIG. 8 is a diagram showing one example of the arrangement of a conventional interlock switch unit 301

The printer 100 includes a power supply 7. The power supply 7 is, for example, a circuit board that includes a plurality of power supply circuits (i.e., a power supply circuit board). The power supply 7 is connected to an alternating-current power source AC. The alternating-current power source AC is, for example, commercial electric power. The power supply 7 is connected via a power supply cable to an outlet for distribution of the commercial electric power. The power supply 7 is connected to the live pole L (non-grounded pole) and the neutral pole N (grounded pole) of the alternating-current power source AC. The printer 100 includes a switch portion 8. The switch portion 8 includes, for example, two switches. These switches are in the following description referred to as the first switch 81 and the second switch 82 respectively. That is, the switch portion 8 is a two-pole unit. The number of poles denotes the number of circuits or electric wires that can be opened or closed with one operation.

As shown in FIG. 1, the printer 100 has a cover 101. The cover 101 can be opened and closed. FIG. 1 shows a state where the cover 101 is closed. In FIG. 1, the arrow marked on the cover 101 indicates one example of the direction in which the cover 101 is opened. Opening the cover 101 exposes the interior of the printer 100 and allows maintenance work. For example, a serviceperson (user) can visually inspect the condition inside. Opening the cover 101 also allows removal of a jammed sheet and replacement of a component.

The switch portion 8 is connected to the alternating-current power source AC. The switch portion 8 (the first and second switches 81 and 82) opens and closes in a manner interlocked with the opening and closing of the cover 101. The first and second switches 81 and 82 open as the cover 101 of the printer 100 is opened, and closes as the cover 101 is closed.

FIGS. 7A and 7B are diagrams showing one example of the first switch 81 according to the embodiment, and FIGS. 7C and 7D are diagrams showing one example of the second switch 82 according to the embodiment. FIG. 7A shows the first switch 81 in a state where the cover 101 is closed, and FIG. 7B shows the first switch 81 in a state where the cover 101 is open. FIG. 7C shows the second switch 82 in a state where the cover 101 is closed, and FIG. 7D shows the second switch 82 in a state where the cover 101 is open. The first and second switches 81 and 82 are each what is called an interlock switch. The first switch 81 has a first contact 81*a*, a second contact 81*b*, a movable plate 81*c*, an elastic member 81*d*, and an actuator 81*e*. The second switch 82 has a first contact 82*a*, a second contact 82*b*, a movable plate 82*c*, an elastic member 82*d*, and an actuator 82*e*. The first and second switches 81 and 82 can be structured similarly.

The first and second switches 81 and 82 are connected to the alternating-current power source AC. Specifically, the first contact 81*a* of the first switch 81 is connected to one of the live and neutral poles L and N of the alternating-current power source AC. The first contact 82*a* of the second switch 82 is connected to the other of the live and neutral poles L and N of the alternating-current power source AC. These first contacts are fed with an alternating-current voltage.

The printer 100 incudes a first supply line 91 and a second supply line 92. The first and second supply lines 91 and 92 are electric wires. As shown in FIG. 6, the first supply line 91 connects the second contact 81*b* to the respective one ends of the heaters 6 (first and second heaters 61 and 62). For example, at one end of the first heater 61 and at one end of the first division heater 62*a*, terminals are provided respectively. The first supply line 91 connects the terminals at those one ends to the second contact 81*b*.

The second supply line 92 connects the second contact 82*b* to the respective other ends of the heaters 6 (first and second heaters 61 and 62). For example, at the other end of the first heater 61, a terminal is provided. Also at the other end of the second division heater 62*b*, a terminal is provided. The other end of the first division heater 62*a* and one end of the second division heater 62*b* are connected together by another electric wire. The second supply line 92 connects the terminals at those other ends to the second contact 82*b*.

The first switch 81, when closed, connects the alternating-current power source AC to the first supply line 91. The second switch 82, when closed, connects the alternating-current power source AC to the second supply line 92. With those switches both closed, electric current can be supplied to the first and second heaters 61 and 62. Only with the first and second switches 81 and 82 both closed can the electric current be passed.

The first switch 81 will be described. The movable plate 81*c* is an electrically conductive member. A state where the movable plate 81*c* is in contact with the first and second contacts 81*a* and 81*b* is a conducting state (closed state, ON state). The movable plate 81*c* moves under the action of the elastic member 81*d* (spring) and the actuator 81*e*. The actuator 81*e* is in contact with the movable plate 81*c*. The elastic member 81*d* urges the actuator 81*e* in such a direction that the movable plate 81*c* moves away from the contacts. When the force pressing the movable plate 81*c* disappears, the movable plate 81*c* moves away from the first and second contacts 81*a* and 81*b*; the first switch 81 then goes into a non-conducting state (open state, OFF state).

The second switch 82 will be described. The movable plate 82*c* is an electrically conductive member. A state where the movable plate 82*c* is in contact with the first and second contacts 82*a* and 82*b* is a conducting state (closed state, ON state). The movable plate 82*c* moves under the action of the elastic member 82*d* (spring) and the actuator 82*e*. The actuator 82*e* is in contact with the movable plate 82*c*. The elastic member 82*d* urges the actuator 82*e* in such a direction that the movable plate 82*c* moves away from the contacts. When the force pressing the movable plate 82*c* disappears, the movable plate 82*c* moves away from the first and second contacts 82*a* and 82*b*; the second switch 82 then goes into a non-conducting state (open state, OFF state).

The cover 101 has a projection 102. The first switch 81 has a hole 81*f* to let the projection 102 through. Likewise, the second switch 82 has a hole 82*f* to let the projection 102 through. When the cover 101 is closed, the projection 102 makes contact with the movable plates 81*c* and 82*c*. When the cover 101 is closed, the projection 102 depresses both the movable plates 81*c* and 82*c* and both the actuators 81*e* and 82*e*. The projection 102 moves the movable plates and the actuators such that the movable plates respectively make contact with the contacts. Two projections 102 may be provided for the first and second switches 81 and 82 respectively. Or a single projection 102 may act on the movable plates of both of the first and second switches 81 and 82.

In a manner interlocked with the closing of the cover 101, the first and second switches 81 and 82 come into the closed state (conducting state, ON state) (see FIGS. 7A and 7C). In contrast, as the cover 101 is opened, the projection 102 ceases to depress the movable plates; the projection 102 thus goes out of contact with the movable plates. As a result, urged by the elastic members 81*d* and 82*d*, the actuator 81*e* moves the movable plate 81*c* in such a direction that it moves away from the contacts and the actuator 82*e* moves the movable plate 82*c* in such a direction that it moves away from the contacts. In a manner interlocked with the opening of the cover 101, the first and second switches 81 and 82 go into the open state (non-conducting state, OFF state) (see FIGS. 7B and 7D).

Here, the second supply line 92 has a branch portion 93 (branch point). In the following description, the parts of the second supply line 92 that branch off from the branch portion 93 to be connected to the respective other ends of the heaters 6 are referred to as the branch lines 94. The respective other ends of the heaters 6 are each connected to one of the branch lines 94. Specifically, one branch line 94 is connected to the other end of the first heater 61, and another branch line 94 is connected to the other end of the second division heater 62*b* (of the second heater 62).

FIG. 6 shows an example where two branch line 94 are provided. In a configuration with three heaters 6, three branch lines 94 are provided. The number of the branch lines 94 provided is equal to the number of heaters 6. The switch portion 8 is disposed between the branch portion 93 and the alternating-current power source AC. Thus, irrespective of the number of heaters 6 or of branch lines 94, a switch portion 8 with two poles will do. Turning the switch portion 8 (first and second switches 81 and 82) off results in opening the first and second supply lines 91 and 92 simultaneously.

In the example under discussion, the first and second division heaters 62*a* and 62*b* are connected in series with each other. Instead, the respective one ends of the first and second division heaters 62*a* and 62*b* may both be connected to the second contact 81*b* of the first switch 81. In that case, one branch line 94 is connected to the other end of the first heater 61, another branch line 94 is connected to the other end of the first division heater 62*a*, and yet another branch line 94 is connected to the other end of the second division heater 62*b*. Thus a total of three branch lines 94 are provided. That is, the first and second division heaters 62*a* and 62*b* may be handled as separate heaters 6.

The power supply 7 includes a zero-cross sensing circuit 70. The zero-cross detection circuit 70 is connected to the first and second supply lines 91 and 92. That is, the zero-cross sensing circuit 70 is fed with the voltage on the first supply line 91 and the voltage on the second supply line 92. The zero-cross detection circuit 70 is a circuit that senses the periodic change of the alternating-current voltage. The zero-cross sensing circuit 70 generates a zero-cross sense signal S0. The power supply 7 generates as the zero-cross sense signal S0, for example, a signal that has one of a high and a low level when the supplied alternating-current voltage has an absolute value equal to or lower than a threshold value and that has the other of the high and low levels when the supplied alternating-current voltage has an absolute value higher than the threshold value. The zero-cross sensing circuit 70 is, for example, a circuit that generates as the zero-cross sense signal S0 a signal that alternates between the high and low levels every half period of the alternating-current voltage. The zero-cross sensing circuit 70 can be a circuit employing a photocoupler, a circuit employing a comparator, or a circuit of any other configuration.

Each branch line 94 is provided with a current control device 95. The current control device 95 allows a bidirectional flow of electric current and thereby permits the alternating-current voltage to be applied to the heater 6. The current control device 95 can control bidirectional electric current. The current control device 95 is, for example, a TRIAC. The printer 100 includes a fixing controller 9 (corresponding to a judgment circuit portion). The fixing controller 9 is, for example, a circuit board that includes a control circuit such as a microprocessor. The fixing controller 9 is connected to the control terminal of the current control device 95. The fixing controller 9 controls the current control device 95 to make it conduct or not conduct electric current. For example, in a print job, the fixing controller 9 supplies electric current to whichever of the first and second heaters 61 and 62 is used. The fixing controller 9 can supply electric power only to the first heater 61 or to both of the first and second heaters 61 and 62, As shown in FIG. 6, the fixing controller 9 may be fed with the output values of the first and second temperature sensors 63*a* and 63*b* provided in the fixing device 5. For example, the first temperature sensor 63*a* measures the temperature in a middle or substantially middle part of the fixing belt 50 in Y direction. The second temperature sensor 63*b* measures the temperature in one of opposite (one and the other) end parts of the fixing belt 50 in Y direction. Based on the output of the first temperature sensor 63*a*, the fixing controller 9 can recognize the temperature in the middle part of the fixing belt 50 in Y direction (i.e., the heating region of the first heater 61). Based on the output of the second temperature sensor 63*b*, the fixing controller 9 can recognize the temperature in the end parts of the fixing belt 50 in Y direction (i.e., the heating region of the second heater 62).

The zero-cross sense signal S0 may be fed to the fixing controller 9. Based on the zero-cross sense signal S0 fed to it and the recognized temperatures, the fixing controller 9 can control the timing of electric current conduction through the current control device 95. In other words, the fixing controller 9 can adjust the magnitudes of the electric power supplied to the individual heaters 6. For example, in a print job, the fixing controller 9 can perform phase control. In phase control, the fixing controller 9 can operate such that, as the temperature recognized based on the output of the first temperature sensor 63*a* is lower, it advances the phase, within a half wave of the alternating-current voltage, at which to make the current control device 95 for the first heater 61 conduct. For another example, the fixing controller 9 can operate such that, as the temperature recognized based on the output of the second temperature sensor 63*b* is lower, it advances the phase, within a half wave of the alternating-current voltage, at which to make the current control device 95 for the second heater 62 conduct.

In a print job, the fixing controller 9 may perform half-wave control. In half-wave control, the fixing controller 9 can operate such that, as the temperature recognized based on the output of the first temperature sensor 63*a* is lower, it increases the number of half waves, within a predetermined number of half waves, throughout which to keep the current control device 95 for the first heater 61 conducting. For another example, the fixing controller 9 can operate such that, as the temperature recognized based on the output of the second temperature sensor 63*b* is lower, it increases the number of half waves, within a predetermined number of half waves, throughout which to keep the current control device 95 for the second heater 62 conducting.

Here, a conventional image forming apparatus will be described. An image forming apparatus has inside its body a component that is fed with a comparatively high voltage. For example, an alternating-current voltage of commercial electric power can be fed to a heater. There is a danger of a serviceperson, when reaching into the image forming apparatus in maintenance work, touching the component fed with the high voltage. With such circumstances in mind, it is conventionally practiced to provide, for prevention of electric shock, a switch that operates in a manner interlocked with the opening and closing of a cover. The switch is connected to the electric wire for the supply of electric power to the component to which the feeding of the voltage should be cut off. For example, as the cover is opened, the switch opens (turns off). Opening the cover thus cuts off the feeding of the voltage to the particular component. In this way the serviceperson, in case of touching the component inside the image forming apparatus, is protected from electric shock.

As there are more components to which to cut off the feeding of the voltage when the cover is opened, there are more electric wires that are connected to the switch for the supply of electric power. As there are more electric wires that are connected to the switch, the switch used needs to have more poles (more incorporated switches). As there are more poles, the switch has an increasingly large size. An increase in the size of the switch leads to an increase in the production cost of the image forming apparatus. An increase in the size of the switch also leads to less flexibility in the design of the image forming apparatus.

Now, one example of a switch unit 301 provided in conventional image forming apparatuses will be described. FIG. 8 shows one example of an electric power supply system in an image forming apparatus that includes the conventional switch unit 301. In the printer 100, a voltage from an alternating-current power source 302 (commercial electric power) is fed to a heater 303 and to a fixing belt disposed in contact with the heater 303. When a cover is opened for removal of a jammed sheet, there is a danger of the serviceperson touching the heater 303 or the fixing belt. The commercial electric power has a comparatively high voltage. An AC voltage of 100 V has a peak voltage of about 140 V. Servicepersons should be protected from electric shock. To that end, a switch unit 301 is often provided that opens and closes in a manner interlocked with the opening and closing of the cover.

Conventionally, a power supply circuit board 305 and a heater 303 are electrically connected together by electric wires for supplying electric power to the heater 303 (energizing electric wires 304). In a case where a plurality of heaters 303 are provided, one of the energizing electric wires 304 is connected to the respective one ends of the heaters 303. To the respective other ends of the heaters 303, other energizing electric wires 304 are connected respectively. Thus, the number of energizing electric wires 304 equals the number of heaters 303 plus one. Conventionally, the switch unit 301 is provided between the power supply circuit board 305 and a fixing unit 306. The conventional switch unit 301 includes one interlock switch 307 for each energizing electric wire 304. Thus, even if part of the interlock switch 307 is faulty, electric shock can be prevented. That is, here, the number of poles in the switch unit 301 equals the number of energizing electric wires 304 that connect the power supply circuit board 305 to the fixing unit 306.

FIG. 8 shows an example of a fixing unit 306 provided with two heaters 303. As shown in FIG. 8, in a case where two heaters 303 are provided, a conventional switch unit 301 has three poles; that is, the switch unit 301 includes three interlock switches 307. In a case where three heaters 303 are provided, the switch unit 301 has four poles. As more interlock switches 307 are incorporated in it the switch unit 301 becomes larger. A larger switch unit 301 requires a higher pressing force. Here, the pressing force is the force with which the cover needs to be pressed to turn all the interlock switches 307 from off to on. As a higher pressure is required, the cover is more likely to cause incomplete depression (contact failure). Contact failure prevents the heaters 303 from being energized, or causes the heaters 303 to be energized unstably.

In view of the above-mentioned problem with the conventional technology, it is preferable to reduce the size of the switch that opens and closes in a manner interlocked with the opening and closing of the cover, thereby to reduce the production cost of the image forming apparatus and obtain more flexibility in design.

On the other hand, the switch portion 8 is disposed between the branch portion 93 and the alternating-current power source AC. By opening the first and second switches 81 and 82 it is possible to leave all of the following electric wires in a non-conducting state: the electric wire connecting the alternating-current power source AC to one end of the first heater 61, the electric wire connecting the alternating-current power source AC to one end of the second heater 62, the electric wire connecting the alternating-current power source AC to the other end of the first heater 61, and the electric wire connecting the alternating-current power source AC to the other end of the second heater 62. It is thus possible to cope with an increased number of heaters 6 with the switch portion 8 that has two poles, and thus to prevent an increase in the size of the unit that includes the interlock switch.

As shown in FIG. 6, the power supply 7 may include a power conversion circuit 7*p*. For example, the power conversion circuit 7*p* converts the alternating-current voltage into a direct-current voltage. The power conversion circuit 7*p* generates, for example, a direct-current voltage for driving a motor. The power conversion circuit 7*p* is, for example, a switching power supply circuit that includes a transformer. The power supply 7 may include a plurality of power conversion circuits 7*p*.

Figure 9:
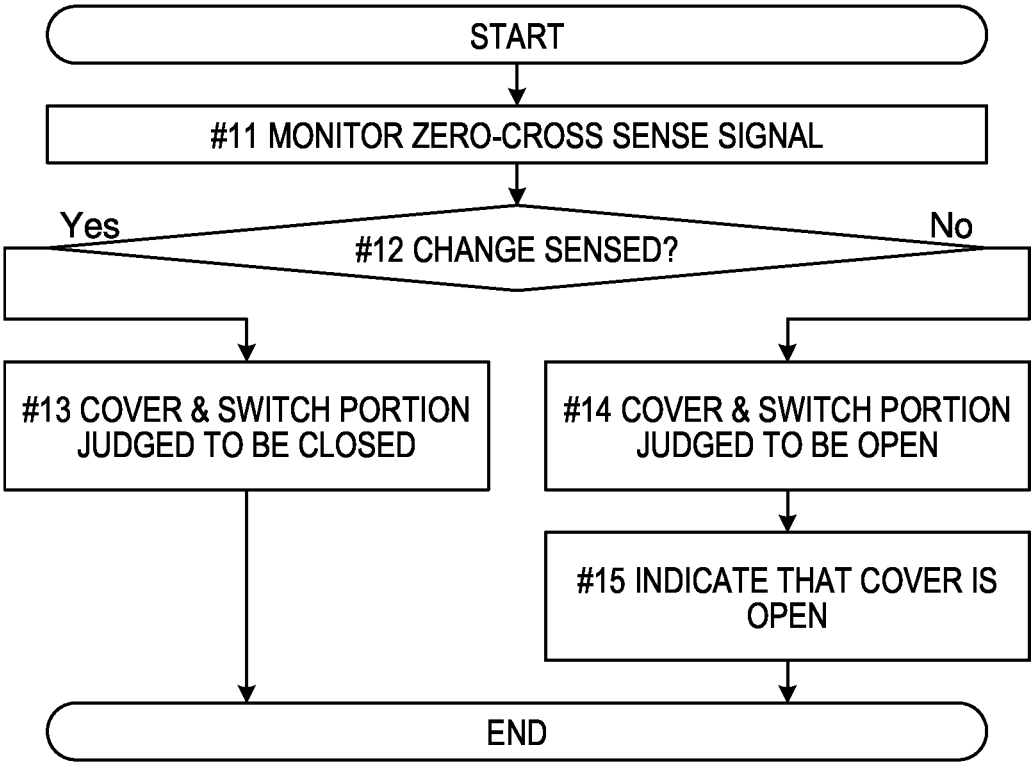
FIG. 9 is a diagram showing one example of the operation for judgment based on a zero-cross sense signal according to the embodiment.

Judgment Based on the Zero-Cross Sense Signal S0: Next, with reference to FIG. 9, one example of the operation for judgement based on the zero-cross sense signal S0 according to the embodiment will be described. FIG. 9 is a diagram showing the example of the operation for judgment based on the zero-cross sense signal S0 according to the embodiment.

The procedure in FIG. 9 starts when the operation for judgment based on the zero-cross sense signal S0 is started. The time at which to start the operation is previously defined. It can be, for example, when the printer 100 has started up as a result of its starting to be supplied with electric power (its starting to be connected to the alternating-current power source AC). It may be a predetermined period of time after the operation for judgment based on the zero-cross sense signal S0 was performed last time. The predetermined period of time may be equal to or less than one second, or one second, or several seconds, or longer than 10 seconds.

The following description deals with an example where the fixing controller 9 acts as a judgment circuit portion that performs the judgment operation. The judgment circuit portion does not necessarily need to be assumed by the fixing controller 9; it may instead be assumed by the control circuit 10 (CPU) in the controller 1, or a control circuit on any other circuit board.

The fixing controller 9 monitors the zero-cross sense signal S0 for a predetermined length of time (step #11). The predetermined length of time is at least equal to or longer than one half period of the alternating-current voltage. For example, the predetermined length of time may be equal to one half period of the alternating-current voltage, or equal to or longer than one period of it. In a case where the alternating-current voltage has a frequency of 50 Hz, the predetermined length of time is set to be longer than 1/100 seconds, and may be longer than 1/50 seconds. The predetermined length of time may be equal to several periods of the alternating-current voltage. Specifically, the fixing controller 9 monitors the zero-cross sense signal S0 to check for changes between the high and low levels for the predetermined length of time. The fixing controller 9 may count the number of times that the zero-cross sense signal S0 changes its level. So long as the zero-cross sensing circuit 70 is sensing the periodic change of the alternating-current voltage, the zero-cross sense signal S0 changes its level periodically.

The fixing controller 9 checks whether the zero-cross sensing circuit 70 is sensing the periodic change of the alternating-current voltage (step #12). Specifically, if during the monitoring the zero-cross sense signal S0 changes its level, the fixing controller 9 can judge that the zero-cross sensing circuit 70 is sensing the periodic change of the alternating-current voltage. If during the monitoring no level change is detected, the fixing controller 9 can judge that the zero-cross sensing circuit 70 is not sensing the periodic change of the alternating-current voltage.

If the zero-cross sensing circuit 70 is judged to be sensing the periodic change of the alternating-current voltage (step #12, "Yes"), the fixing controller 9 judges that the cover 101 and the switch portion 8 (the first and second switches 81 and 82) are closed (step #13, to END). If the zero-cross sensing circuit 70 is judged not to be sensing the periodic change of the alternating-current voltage (step #12, "No"), the fixing controller 9 judges that the cover 101 and the switch portion 8 (the first and second switches 81 and 82) are open (step #14).

If the cover 101 and the switch portion 8 are judge to be open, the fixing controller 9 may make an indicating portion indicate that the cover 101 is open (step #15, to END). The cover 101 can be sensed to be open, and the absence of a fault can be indicated. For example, the indicating portion can be assumed by the display panel 31. The display panel 31 displays a message. For example, notified by the fixing controller 9, the controller 1 makes the display panel 31 display a message indicating that the cover 101 is open. The controller 1 can make the display panel 31 keep displaying the message indicating that the cover 101 is open until the fixing controller 9 judges the cover 101 to be closed.

The controller 1 communicates with the fixing controller 9. The controller 1 is notified by the fixing controller 9 of the result of the judgment. If the cover 101 and the switch portion 8 are open, the controller 1 does not operate the motor that rotates the rotary members (rollers) in the printing portion 40. Only after the cover 101 and the switch portion 8 are closed does the controller 1 restart the motor that rotates the rotary members (rollers) in the printing portion 40. For example, if a jammed sheet stops printing, it is after the sheet is removed and the cover 101 is closed that printing is restarted.

An image forming apparatus (printer 100) according to the embodiment includes a plurality of heaters 6 (first and second heaters 61 and 62), a switch portion 8, a first supply line 91, and a second supply line 92. The plurality of heaters 6 heats a toner image. The switch portion 8 is connected to the alternating-current power source AC. The switch portion 8 opens and closes in a manner interlocked with the opening and closing of the cover 101. The first supply line 91 connects the respective one ends of the heaters 6 to the switch portion 8. The second supply line 92 connects the respective other ends of the heaters 6 to the switch portion 8. The second switch 82 has a branch portion 93. The respective other ends of the heaters 6 are each connected to one of branch lines 94 which are electric wires that branch off from the branch portion 93. The switch portion 8 is disposed between the branch portion 93 and the alternating-current power source AC.

Thus, simply opening the cover 101 permits all the terminals of the heaters 6 to be disconnected from the alternating-current power source AC. A conventional configuration with a plurality of heaters 6 requires a switch with a large number of poles (a large number of incorporated interlock switches) and hence a large-size switch. The contact-to-contact distance with the cover 101 open (the minimum distance to be secured between contacts) is often prescribed in a standard. As there are more poles, the switch tends to have an increasingly large size. In the image forming apparatus according to the embodiment, the switch portion 8 is disposed at the side of the branch portion 93 closer to the alternating-current power source AC. That is, a non-branching part of the second supply line 92 is connected to the switch portion 8. Accordingly, the switch portion 8 has only to be a mechanism that switches two electric wires between a conducting and a non-conducting state. This helps keep small the switch portion 8 that opens and closes in a manner interlocked with the opening and closing of the cover 101. Compared with a configuration employing a large-size switch, it is possible to reduce the production cost of the image forming apparatus. Moreover, the small switch portion 8 requires less restrictions on the arrangement of components in the image forming apparatus, and thus provides more flexibility in the mechanical design of the image forming apparatus. A large switch requires a high pressing force to be turned from off to on. A high pressing force required is likely to lead to incomplete depression. A small switch portion 8 requires a low pressing force to be turned between on and off, and is less likely to cause incomplete depression.

The switch portion 8 includes a first switch 81 and a second switch 82. The first switch 81 is connected to one of the live and neutral poles L and N of the alternating-current power source AC. With the cover 101 open, the first switch 81 is open, keeping the alternating-current power source AC disconnected from the first supply line 91. With the cover 101 closed, the first switch 81 is closed, keeping the alternating-current power source AC connected to the first supply line 91. The second switch 82 is connected to the other of the live and neutral poles L and N of the alternating-current power source AC. With the cover 101 open, the second switch 82 is open, keeping the alternating-current power source AC disconnected from the second supply line 92. With the cover 101 closed, the second switch 82 is closed, keeping the alternating-current power source AC connected to the second supply line 92. The connection between the first supply line 91 and the alternating-current power source AC and the connection between the second supply line 92 and the alternating-current power source AC can be cut. Opening the cover 101 reliably stops the feeding of the voltage to the heaters 6.

The image forming apparatus according to the embodiment includes a zero-cross sensing circuit 70, a judgement circuit portion (fixing controller 9), and an indicating portion (display panel 31). The zero-cross sensing circuit 70 is provided between the switch portion 8 and the heater 6. The zero-cross sensing circuit 70 is connected to the first and second switches 81 and 82. The zero-cross sensing circuit 70 generates a zero-cross sense signal S0 in accordance with the alternating-current voltage supplied from the alternating-current power source AC. The judgement circuit portion is fed with the zero-cross sense signal S0. The indicating portion indicates a message. When the zero-cross sensing circuit 70 is not sensing the periodic change of the alternating-current voltage, the indicating portion indicates that the cover 101 is open. Thus, with the zero-cross sensing circuit 70, it is possible to judge whether the cover 101 and the switch portion 8 are open. Judging whether the cover 101 is open does not require a mechanical switch that makes contact with the cover 101. As compared with a configuration that requires a mechanical switch, it is possible to reduce the production cost of the image forming apparatus.

Each branch line 94 is provided with a current control device 95 that controls bidirectional electric current based on the zero-cross sense signal S0. Thus, based on the zero-cross sense signal S0, the electric power that is supplied to the heaters 6 during printing can be controlled precisely (phase control, half-wave control). The zero-cross sensing circuit 70 can be used to control the timing of the supply of electric power to the heaters 6. The zero-cross sensing circuit 70 can be used for more than one purpose.

Figure 10:
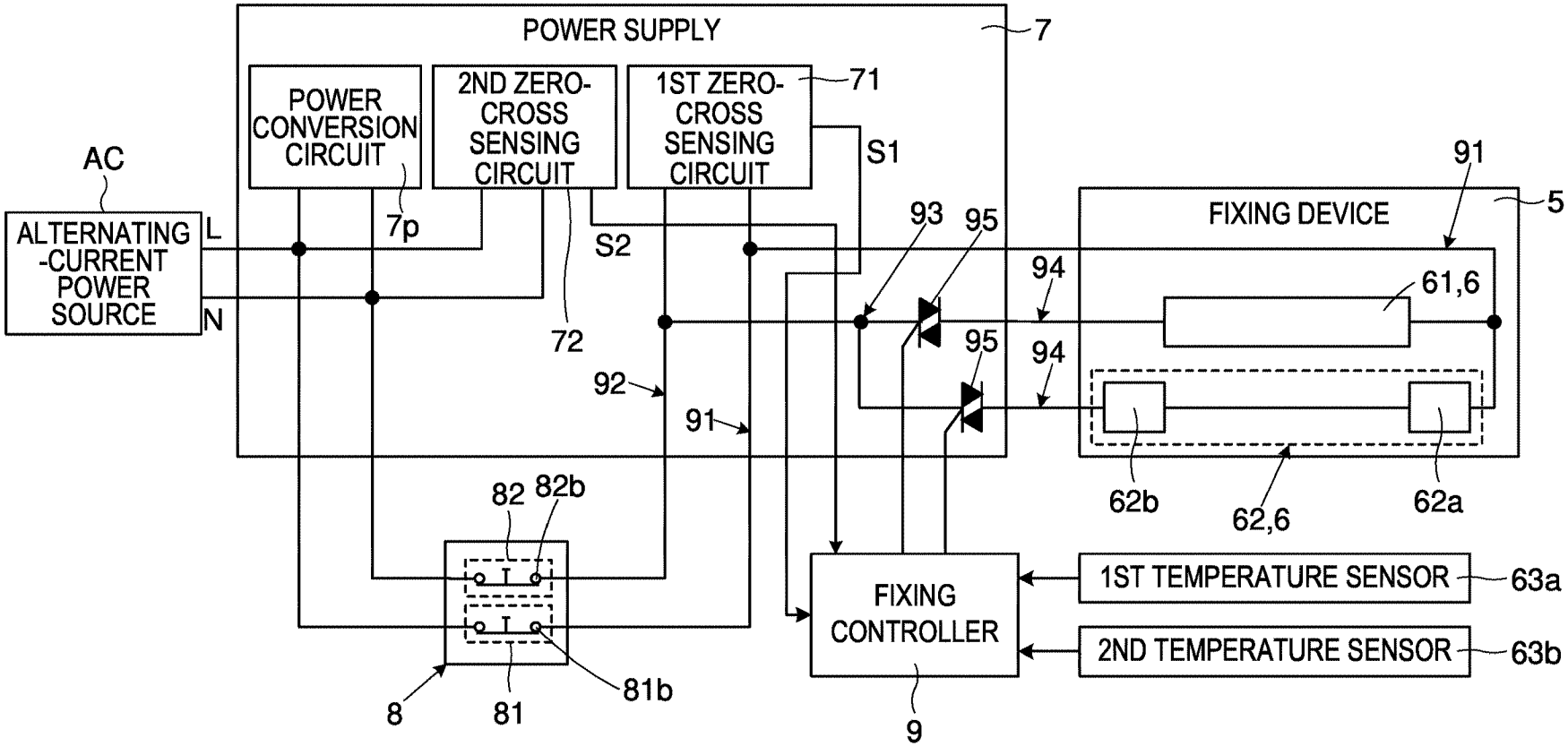
FIG. 10 is a diagram showing one example of the supply of electric power to the heaters 6 in the fixing device 5 according to a modified example.
Figure 11:
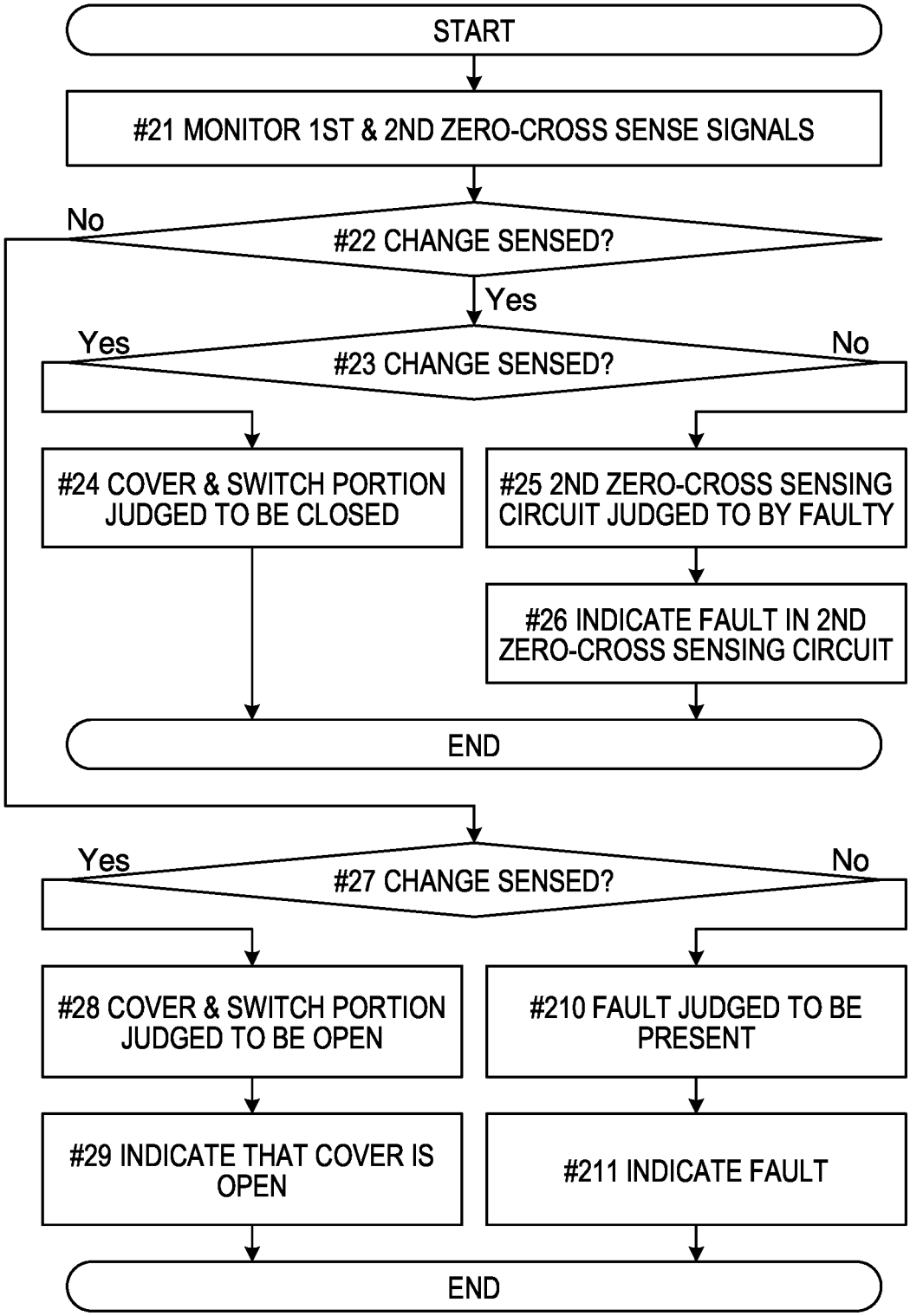
FIG. 11 is a diagram showing one example of the operation for judgement based on a first and a second zero-cross sense signal according to the modified example.

Modified Examples: Next, with reference to FIGS. 10 and 11, a modified example of the printer 100 according to the embodiment will be described. FIG. 10 is a diagram showing one example of the supply of electric power to the heaters 6 in the fixing device 5 according to the modified example. FIG. 11 is a diagram showing one example of the operation for judgement based on a first zero-cross sense signal S1 and a second zero-cross sense signal S2 according to the modified example.

The printer 100A according to the modified example differs from the printer 100 according to the embodiment in that it includes one more zero-cross sensing circuit. In other respect, the printer 100A according to the modified example is similar to the printer 100 according to the embodiment. In the following description of the modified example, the same members as in the printer 100 according to the embodiment are identified by the same reference signs; for the same features as described previously, the corresponding description applies equally and no detailed description will be repeated.

The printer 100A according to the modified example includes a first zero-cross sensing circuit 71 and a second zero-cross sensing circuit 72. The first zero-cross sensing circuit 71 may be the same circuit as the zero-cross sensing circuit 70 provided in the printer 100 according to the embodiment. The first zero-cross sensing circuit 71 is provided between the switch portion 8 and the heater 6, is connected to the first and second supply lines 91 and 92, and generates a first zero-cross sense signal S1 in accordance with the alternating-current voltage supplied from the alternating-current power source AC. The second zero-cross sensing circuit 72 is provided between the switch portion 8 and the alternating-current power source AC. The second zero-cross sensing circuit 72 is connected to the live and neutral poles L and N of the alternating-current power source AC. The second zero-cross sensing circuit 72 generates a second zero-cross sense signal S2 based on the alternating-current voltage.

The first zero-cross sensing circuit 71 generates as the first zero-cross sense signal S1 a signal that has one of a high and a low level when the supplied alternating-current voltage has an absolute value equal to or lower than a threshold value and that has the other of the high and low levels when the supplied alternating-current voltage has an absolute value higher than the threshold value. The first zero-cross sense signal S1 is, for example, a signal that changes its level every half period of the alternating-current voltage. When sensing the periodic change of the alternating-current voltage, the first zero-cross sensing circuit 71 outputs a signal that changes periodically.

The second zero-cross sensing circuit 72 generates as the second zero-cross sense signal S2 a signal that has one of a high and a low level when the supplied alternating-current voltage has an absolute value equal to or lower than a threshold value and that has the other of the high and low levels when the supplied alternating-current voltage has an absolute value higher than the threshold value. The second zero-cross sense signal S2 is, for example, a signal that changes its level every half period of the alternating-current voltage. When sensing the periodic change of the alternating-current voltage, the second zero-cross sensing circuit 72 outputs a signal that changes periodically. The first and second zero-cross sensing circuits 71 and 72 can each be a circuit employing a photocoupler, a circuit employing a comparator, or a circuit of any other configuration. The first and second zero-cross sensing circuits 71 and 72 may have the same circuit configuration, or may have different circuit configurations.

Next, with reference to FIG. 11, a description will be given of one example of the operation for judgment based on the first and second zero-cross sense signal S1 and S2 on the printer 100A according to the modified example. The procedure in FIG. 11 starts when the operation for judgment according to the modified example is started. The time at which to start the operation is previously defined. It can be, for example, when the printer 100A has started up as a result of its starting to be supplied with electric power (its starting to be connected to the alternating-current power source AC). It may be a predetermined period of time after the operation for judgment based on the zero-cross sense signal was performed last time. The predetermined period of time may be equal to or less than one second, or one second, or several seconds, or longer than 10 seconds.

The following description deals with an example where the fixing controller 9 acts as a judgment circuit portion that performs the judgment operation according to the modified example. The judgment circuit portion does not necessarily need to be assumed by the fixing controller 9; it may instead be assumed by the control circuit 10 (CPU) in the controller 1, or a control circuit on any other circuit board.

The fixing controller 9 monitors the first and second zero-cross sense signals S1 and S2 for a predetermined length of time (step #21). The predetermined length of time is at least equal to or longer than one half period of the alternating-current voltage. For example, the predetermined length of time may be equal to one half period of the alternating-current voltage, or equal to or longer than one period of it. In a case where the alternating-current voltage has a frequency of 60 Hz, the predetermined length of time is set to be longer than 1/120 seconds, and may be longer than 1/60 seconds. The predetermined length of time may be equal to several periods of the alternating-current voltage. When each zero-cross sensing circuit is sensing the periodic change of the alternating-current voltage, the corresponding zero-cross sense signal changes its level periodically. Specifically, the fixing controller 9 monitors the first zero-cross sense signal S1 to check for changes between the high and low levels for the predetermined length of time. The fixing controller 9 may count the number of times that the first zero-cross sense signal S1 changes its level. The fixing controller 9 also monitors the second zero-cross sense signal S2 to check for changes between the high and low levels for the predetermined length of time. The fixing controller 9 may count the number of times that the second zero-cross sense signal S2 changes its level.

The fixing controller 9 checks whether the first zero-cross sensing circuit 71 is sensing the periodic change of the alternating-current voltage (step #22). Specifically, if during the monitoring the first zero-cross sense signal S1 changes its level, the fixing controller 9 can judge that the first zero-cross sensing circuit 71 is sensing the periodic change of the alternating-current voltage. If during the monitoring no level change is detected, the fixing controller 9 can judge that the first zero-cross sensing circuit 71 is not sensing the periodic change of the alternating-current voltage.

If the first zero-cross sensing circuit 71 is judged to be sensing the periodic change of the alternating-current voltage (step #22, "Yes"), the fixing controller 9 checks whether the second zero-cross sensing circuit 72 is sensing the periodic change of the alternating-current voltage (step #23). Specifically, if during the monitoring the second zero-cross sense signal S2 changes its level, the fixing controller 9 can judge that the second zero-cross sensing circuit 72 is sensing the periodic change of the alternating-current voltage. If during the monitoring no level change is detected, the fixing controller 9 can judge that the second zero-cross sensing circuit 72 is not sensing the periodic change of the alternating-current voltage.

If the second zero-cross sensing circuit 70, too, is judged to be sensing the periodic change of the alternating-current voltage (step #23, "Yes"), the fixing controller 9 judges that the cover 101 and the switch portion 8 are closed (step #24, to END). By contrast, if the second zero-cross sensing circuit 72 is judged not to be sensing the periodic change of the alternating-current voltage (step #23, "No"), there is a discrepancy between the sensing results of the two zero-cross sensing circuits. One possible cause is that the second zero-cross sensing circuit 72 is faulty. Accordingly the fixing controller 9 judges that the second zero-cross sensing circuit 72 is faulty (step #25). In this case, the fault needs to be indicated to the user. Accordingly, the fixing controller 9 makes the indicating portion indicate the fault of the second zero-cross sensing circuit 72 (step #26 to "END"). The indicating portion is assumed by, for example, the display panel 31. Notified by the fixing controller 9, the controller 1 makes the display panel 31 display a message indicating the fault in the second zero-cross sensing circuit 72.

On the other hand, if the first zero-cross sensing circuit 71 is judged not to be sensing the periodic change of the alternating-current voltage (step #22, "No"), the fixing controller 9 checks whether the second zero-cross sensing circuit 72 is sensing the periodic change of the alternating-current voltage (step #27). The operation at step #27 is similar to that at step #23.

If the second zero-cross sensing circuit 72, too, is judged to be sensing the periodic change of the alternating-current voltage (step #27, "Yes"), this implies a state where the switch portion 8 is fed with alternating-current electric power but is blocking it, i.e., a state where the cover 101 is open and the switch portion 8 is open. Accordingly, the fixing controller 9 judges that the cover 101 and the switch portion 8 (first and second switches 81 and 82) are open (step #28). If the cover 101 and the switch portion 8 are judged to be open, the fixing controller 9 may make the indicating portion indicate that the cover 101 is open (step #29 to "END"). The cover 101 can be sensed to be open, and the absence of a problem can be indicated. For example, the indicating portion can be assumed by the display panel 31. The display panel 31 displays a message. For example, notified by the fixing controller 9, the controller 1 makes the display panel 31 display a message indicating that the cover 101 is open.

If the second zero-cross sensing circuit 72 is judged not to be sensing the periodic change of the alternating-current voltage (step #27, "No"), this implies a state where the fixing controller 9 is operating but neither of the sensing circuits is sensing the alternating-current voltage at all. Some fault is likely to be present. For example, the first and second zero-cross sensing circuits 71 and 72 may both be faulty. Or one of the electric wires may be faulty. It is impossible to definitively sense whether the cover 101 is open or closed. Thus, the fixing controller 9 judges that a fault is present (step #210). In this case, the fault needs to be indicated to the user. Accordingly, the fixing controller 9 makes the indicating portion indicate the presence of the fault (step #211 to "END"). Notified by the fixing controller 9, the controller 1 makes the display panel 31 display a message indicating the presence of the fault.

An image forming apparatus according to the modified example includes a first zero-cross sensing circuit 71, a second zero-cross sensing circuit 72, and an indicating portion. The first zero-cross sensing circuit 71 is provided between the switch portion 8 and the heaters 6. The first zero-cross sensing circuit 71 is connected to the first and second supply lines 91 and 92. The first zero-cross sensing circuit 71 generates a first zero-cross sense signal S1 in accordance with the alternating-current voltage supplied from the alternating-current power source AC. The second zero-cross sensing circuit 72 is provided between the switch portion 8 and the alternating-current power source AC. The second zero-cross sensing circuit 72 is connected to the live and neutral poles L and N of the alternating-current power source AC. The second zero-cross sensing circuit 72 generates a second zero-cross sense signal S2 in accordance with the alternating-current voltage. The indicating portion indicates a message. When the first zero-cross sensing circuit 71 is not sensing the periodic change of the alternating-current voltage and the second zero-cross sensing circuit 72 is sensing the periodic change of the alternating-current voltage, the indicating portion indicates that the cover 101 is open. Thus, based on the first and second zero-cross sense signals S1 and S2, whether the cover 101 and the switch portion 8 are open is recognized; whether the cover 101 and the switch portion 8 are open can be indicated.

The image forming apparatus according to the modified example includes a judgement circuit portion (fixing controller 9) that is fed with the first and second zero-cross sense signals S1 and S2. If the first zero-cross sensing circuit 71 is sensing the periodic change of the alternating-current voltage and also the second zero-cross sensing circuit 72 is sensing the periodic change of the alternating-current voltage, the judgement circuit portion judges that the cover 101 is closed. Thus, if the side at which the alternating-current power source AC is disposed is referred to as the front side (upstream side), then a zero-cross sensing circuit 70 can be provided in each of a front and a rear stage with respect to the switch portion 8. Based on the first and second zero-cross sense signals S1 and S2, it is possible to recognize that the cover 101 and the switch portion 8 are closed.

If the first zero-cross sensing circuit 71 is sensing the periodic change of the alternating-current voltage but the second zero-cross sensing circuit 72 is not sensing the periodic change of the alternating-current voltage, the indicating portion according to the modified example indicates that the second zero-cross sensing circuit 72 is faulty. In this way, based on the first and second zero-cross sense signals S1 and S2, a fault in the second zero-cross sensing circuit 72 can be detected; a fault in the second zero-cross sensing circuit 72 can be indicated.

If the first zero-cross sensing circuit 71 is not sensing the periodic change of the alternating-current voltage and also the second zero-cross sensing circuit 72 is not sensing the periodic change of the alternating-current voltage, the indicating portion according to the modified example indicates that a fault is present. In this way, based on the first and second zero-cross sense signals S1 and S2, the presence of a fault can be detected; the presence of a fault can be indicated.

The image forming apparatus according to the modified example includes a first zero-cross sensing circuit 71 that is connected to the first and second supply lines 91 and 92 and that generates a first zero-cross sense signal S1 in accordance with the alternating-current voltage supplied from the alternating-current power source AC. Each branch line 94 is provided with a current control device 95 that controls bidirectional electric current based on the first zero-cross sense signal S1. Thus, based on the zero-cross signal, the electric power supplied to the heaters 6 during printing can be controlled precisely (phase control, half-wave control). The zero-cross sensing circuit can be employed to control the timing of the supply of electric power to the heaters 6 during printing; the zero-cross sensing circuit can be employed for more than one purpose.

While an embodiment of the present disclosure and a modified example of it have been described above, they are not meant to limit the scope of the present disclosure, which thus allows for various modifications without departure from the spirit of the present disclosure. For example, while the above description deals with an example where the indicating portion is assumed by the display panel 31, the indicating portion may be assumed by one of the display panel 31 and the communication circuit portion 12 or both. When issuing an indication, the communication circuit portion 12 transmits a message to a computer 200 with which it can communicate.

The present disclosure finds applications in image forming apparatuses that include a fixing device.

What is claimed is:

1. An image forming apparatus comprising:

a plurality of heaters for heating a toner image;

a switch portion connected to an alternating-current power source, the switch portion opening and closing in a manner interlocked with opening and closing of a cover;

a first supply line connecting respective one ends of the heaters to the switch portion; and a second supply line connecting respective other ends of the heaters to the switch portion, wherein the second supply line has a branch portion, the respective other ends of the heaters are each connected to one of branch lines which are electric wires that branch off from the branch portion, and the switch portion is disposed between the branch portion and the alternating-current power source.

2. The image forming apparatus according to claim 1, wherein the switch portion includes a first switch and a second switch, the first switch is connected to one of a live pole and a neutral pole of the alternating-current power source, with the cover open the first switch being open so as to keep the alternating-current power source disconnected from the first supply line, with the cover closed the first switch being closed so as to keep the alternating-current power source connected to the first supply line, the second switch is connected to the other of the live pole and the neutral pole of the alternating-current power source, with the cover open the second switch being open so as to keep the alternating-current power source disconnected from the second supply line, with the cover closed the second switch being closed so as to keep the alternating-current power source connected to the second supply line.

3. The image forming apparatus according to claim 1, further comprising:

a zero-cross sensing circuit disposed between the switch portion and the heaters, the zero-cross sensing circuit being connected to the first and second supply lines, the zero-cross sensing circuit generating a zero-cross sense signal in accordance with an alternating-current voltage supplied from the alternating-current power source;

a judgement circuit portion fed with the zero-cross sense signal; and an indicating portion that indicates a message, wherein when the zero-cross sensing circuit is not sensing periodic change of the alternating-current voltage, the indicating portion indicates that the cover is open.

4. The image forming apparatus according to claim 1, further comprising:

a first zero-cross sensing circuit disposed between the switch portion and the heaters, the first zero-cross sensing circuit being connected to the first and second supply lines, the first zero-cross sensing circuit generating a first zero-cross sense signal in accordance with an alternating-current voltage supplied from the alternating-current power source;

a second zero-cross sensing circuit disposed between the switch portion and the alternating-current power source, the second zero-cross sensing circuit being connected to the live and neutral poles of the alternating-current power source, the second zero-cross sensing circuit generating a second zero-cross sense signal in accordance with the alternating-current voltage;

an indicating portion that indicates a message, wherein when the first zero-cross sensing circuit is not sensing periodic change of the alternating-current voltage and the second zero-cross sensing circuit is sensing periodic change of the alternating-current voltage, the indicating portion indicates that the cover is open.

5. The image forming apparatus according to claim 4, further comprising:

a judgement circuit portion fed with the first and second zero-cross sense signals, wherein when the first zero-cross sensing circuit is sensing periodic change of the alternating-current voltage and the second zero-cross sensing circuit is sensing periodic change of the alternating-current voltage, the judgement circuit portion judges that the cover is closed.

6. The image forming apparatus according to claim 4, wherein when the first zero-cross sensing circuit is sensing periodic change of the alternating-current voltage and the second zero-cross sensing circuit is not sensing periodic change of the alternating-current voltage, the indicating portion indicates that the second zero-cross sensing circuit is faulty.

7. The image forming apparatus according to claim 4, wherein when the first zero-cross sensing circuit is not sensing periodic change of the alternating-current voltage and the second zero-cross sensing circuit is not sensing periodic change of the alternating-current voltage, the indicating portion indicates that a fault is present.

8. The image forming apparatus according to claim 1, further comprising:

a zero-cross sensing circuit connected to the first and second supply lines, the zero-cross sensing circuit generating a zero-cross sense signal in accordance with an alternating-current voltage supplied from the alternating-current power source, wherein each of the branch lines is provided with a current control device that controls bidirectional electric current based on the zero-cross sense signal.

* * * * *